United States Patent [19]

Marten

[11] Patent Number: 4,542,940

[45] **Date of Patent: * Sep. 24, 1985**

[54] METHOD AND APPARATUS FOR CUTTING A TRENCH THROUGH ROCK-LIKE MATERIAL

[75] Inventor: Edward N. Marten, Von Ormy, Tex.

[73] Assignee: H. B. Zachry Co., San Antonio, Tex.

[ * ] Notice: The portion of the term of this patent subsequent to Jul. 14, 2000 has been disclaimed.

[21] Appl. No.: 103,231

[22] Filed: Dec. 13, 1979

Related U.S. Application Data

[63] Continuation-in-part of Ser. No. 966,338, Dec. 4, 1978, Pat. No. 4,230,372.

[51] Int. Cl.[4] ..... E21C 27/10

[52] U.S. Cl. ..... 299/1; 37/96; 299/13; 299/15; 299/39; 173/8

[58] Field of Search ..... 299/10, 13, 15, 1, 39, 299/72, 75, 81; 173/43, 8; 37/84, 94, 96; 405/165

[56] References Cited

U.S. PATENT DOCUMENTS

| | | | |
|---|---|---|---|
| 428,951 | 5/1890 | Richards | 299/72 |
| 1,858,360 | 5/1932 | Cruse | 37/94 |
| 2,517,267 | 8/1950 | Watson | 299/72 |
| 3,222,876 | 12/1965 | Harmstorf | 405/165 |
| 3,374,033 | 3/1968 | Arentzen | 299/81 |
| 3,550,961 | 12/1970 | Hughes | 299/72 |
| 3,596,997 | 8/1971 | Valantin | 299/72 |
| 3,632,172 | 1/1972 | Robinson et al. | 299/13 |
| 3,706,284 | 12/1972 | Plasser et al. | 299/1 |
| 3,750,762 | 8/1973 | Eaton | 173/8 |

FOREIGN PATENT DOCUMENTS

| | | | |
|---|---|---|---|
| 2622738 | 8/1977 | Fed. Rep. of Germany | 299/1 |

*Primary Examiner*—Ernest R. Purser

*Attorney, Agent, or Firm*—Hubbard, Thurman, Turner & Tucker

[57] ABSTRACT

Apparatus and method for digging deep trenches having parallel generally vertical walls in solid rock such as limestone. The apparatus includes a transport means for providing support and for moving along a traverse on the earth's surface while cutting a trench along that traverse. The transport carries a boom which may be articulated into the ditch being cut and a pair of rock cutterwheels carried on the end of the boom and assembled so that the outermost cutter teeth are wider than any other part of the boom assembly. The apparatus further includes means for aligning the flat surfaces of the rock cutter wheels parallel to and between the walls of the ditch and for maintaining alignment of the wheels with the trench as the transport moves along the traverse so that repeated cuts may be made to extend the trench to any desired depth. The trenching method includes the cutting of a pair of narrow slots by means of the rock saws as the transport moves along the traverse and then removing material between the slots. The method further includes repositioning the cutter wheels in a previously cut trench to make second cuts extending the depth of the trench to a preselected depth.

32 Claims, 13 Drawing Figures

METHOD AND APPARATUS FOR CUTTING A TRENCH THROUGH ROCK-LIKE MATERIAL

BACKGROUND OF THE INVENTION

This application is a continuation-in-part of my copending U.S. Pat. application Ser. No. 966,338, now U.S. Pat. No. 4,230,372 filed Dec. 4, 1978 which is thereby incorporated by reference.

This invention relates to apparatus and methods for digging trenches in the earth's surface for laying pipes and the like, and more particularly to apparatus and methods for cutting narrow generally vertical walled trenches in solid rock such as limestone.

References which are known to the present applicant and which are believed to be relevant to the present invention include the following U.S. Pat. Nos.: 1,472,563 issued to Loken on Oct. 30, 1923; U.S. Pat. No. 2,780,452 issued to Marcerou on Feb. 5, 1957; U.S. Pat. No. 3,364,602 issued to Renzaglia on Jan. 23, 1968; and U.S. Pat. No. 428,951 issued to Richards on May 27, 1890; U.S. Pat. No. 2,517,267 issued to Watson on Aug. 1, 1950; and U.S. Pat. No. 3,596,997 issued to Valantin on Aug. 3, 1971.

The Loken patent discloses improvements to the bucket wheel trenching machines commonly used for pipe laying. Such machines are quite useful in most normal soils and even in some soft rocks, but the depth of cut is limited by the diameter of the bucket wheel itself. For very large depths, the equipment becomes quite massive.

The Marcerou patent teaches a rock cutting machine for use in quarries. The machine is manually adjustable and is designed to drive a pair of relatively small rock cutter wheels into the face of a stone wall while a head tool cuts a hole for the driving equipment and a pair of side cutters cut side grooves for stabilizing the device as it penetrates into the rock.

The Renzaglia patent teaches the use of a larger cutter wheel pivotally mounted on the back of a tractor for use in cutting roots. It is apparent from the illustrated apparatus that the depth of cut provided by this apparatus is limited to somewhat less than the radius of the cutter wheel.

The Richards, Watson and Valantin patents all teach mining machines having double rock cutter wheels or toothed chains for making multiple cuts into the face of a mine wall such as coal. None of these patents are adapted for digging trenches along a traverse on the earth's surface since they are not adapted for cutting while moving and none of them provide sufficient articulation of the mechanisms to completely insert the cutter wheels into a previously cut trench and maintain alignment while the mechanism moves along a traverse.

Thus it is seen that while rock saws or cutter wheels have been known and used for various purposes, they have not been applied to the cutting of trenches for laying of pipelines. It can also be seen that it is desirable to provide a trench cutting apparatus capable of digging deep, narrow trenches in hard rocky materials which is relatively lightweight and simple compared to the prior known devices.

SUMMARY OF THE INVENTION

Accordingly, an object of the present invention is to provide a trench rock saw which can cut generally vertical walled narrow trenches to relatively great depth in solid rock materials.

Another object of the present invention is to provide a relatively simple and lightweight trenching machine capable of cutting trenches to relatively great depths.

Another object of the present invention is to provide an improved trenching machine and method of cutting trenches.

Trenching apparatus according to the present invention includes transport means for providing a support and for moving along a preselected traverse on the earth's surface, a boom carried by the transport having a first end articulable into a substantially vertical walled trench in the earth's surface along the traverse, a double rock cutter wheel assembly carried on the end of the boom, and alignment means in the transport and boom arrangement for aligning flat surfaces of the rock cutter wheels parallel to and in between walls of the trench being cut along the traverse and maintaining alignment so that the cutter wheels may be returned to the trench for subsequent cuts until a desired trench depth is reached. A method of digging trenches includes positioning of the dual rock cutter wheel assembly on and into the earth's surface for cutting a pair of parallel vertically walled slots as the transport means moves along the preselected traverse and then removing material between the slots to provide a generally vertically walled open trench of a first depth. The method further includes repositioning the dual cutter wheel assembly in a previously cut trench and cutting vertically walled slots in the bottom of the open trench while the transport moves along the preselected traverse and again removing mateial between the slots to increase the depth of the vertically walled trench.

BRIEF DESCRIPTION OF THE DRAWINGS

The present invention may be better understood by reading the following detailed description of the preferred embodiments with reference to the accompanying drawings, wherein.

DESCRIPTION OF THE PREFERRED EMBODIMENT

Figure 1:
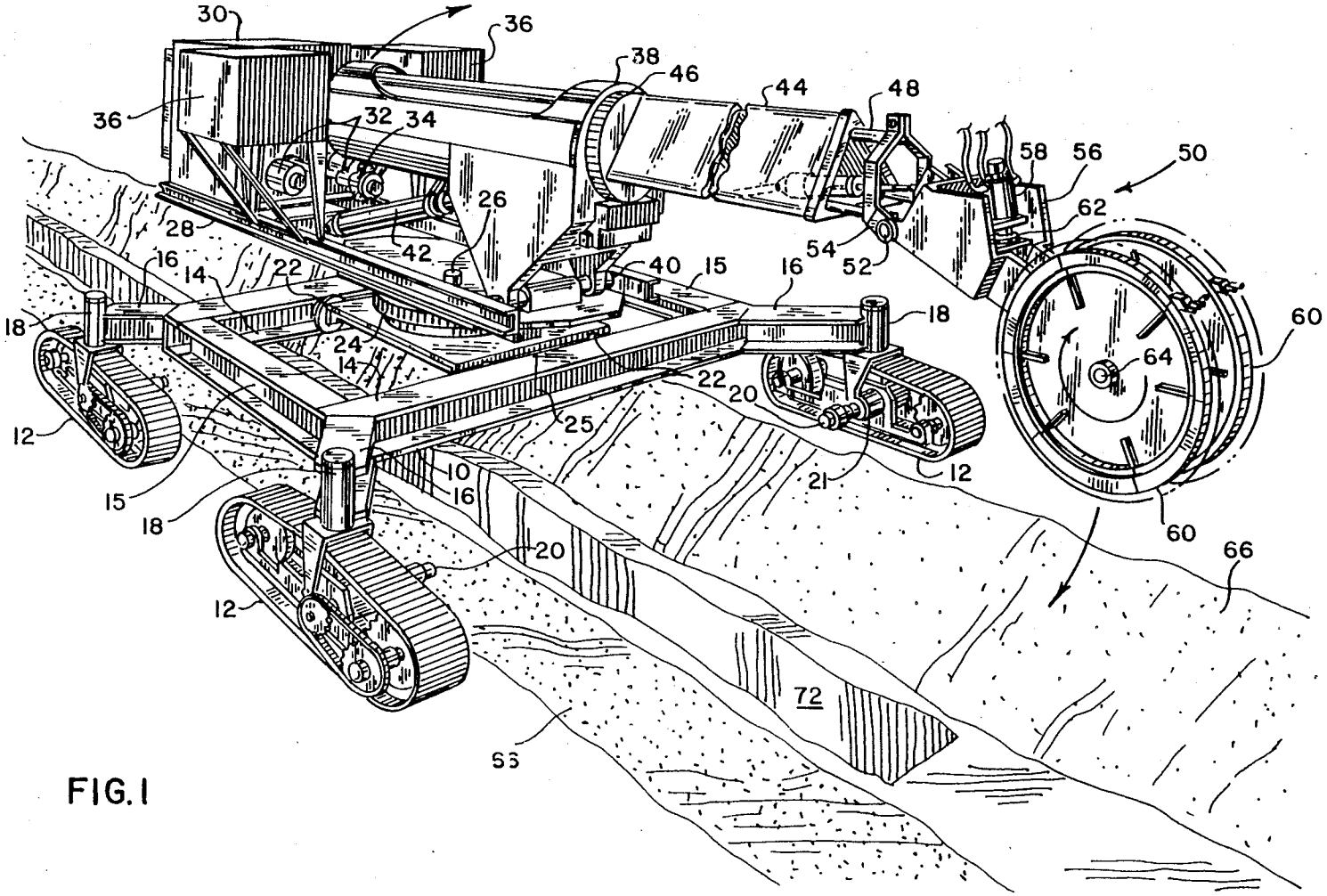
FIG. 1 is a perspective view of a first embodiment of the present invention.

With reference now to FIG. 1, most of the details of a first embodiment of the present invention are illustrated in a perspective view. A base 10 comprising steel I-beams assembled in a rectangle is supported on its four corners by traction units 12. Two of the I-beams forming base 10 also form a pair of tranverse rails 14 for supporting the rest of the apparatus. The remaining two I-beams 15 may also be used for cross rails in a slightly modified form of the present equipment. Arms 16 extend diagonally out from the corners of base 10 and connect the traction units 12 to the base. A pivot 18 is provided at the end of each arm 16 to allow the traction units 12 to move in essentially any direction and also to allow the arms 16 to be raised relative to traction units 12. It can be seen that since base 10 and arms 16 form a rigid, flat surface and the surface of the earth is rarely perfectly flat, especially in construction areas, it is necessary that at least some of the arms 16 have the capacity for being raised relative to the traction units 12. While, as illustrated, each of the traction units 12 is independently free to rotate about its pivot 18, it is normally desirable to provide lateral tie rods to keep pairs of the traction units 12 aligned with each other. In this embodiment each of the traction units 12 is a conventional crawler unit riding on steel treads and driven by a fluid-drive motor 20 through a gear reducer 21. For general use, the treads of traction units 12 are not cleated, making it more important that the extension arms 16 have the ability to be raised relative to the traction units 12 to assure even loading of each of the units 12.

Four rollers or wheels 22 are provided for riding in the rails 14 and, in turn, suporting a turntable 24. The rails 14 and rollers 22 provide, in this embodiment, means for moving the rest of the apparatus of FIG. 1 laterally relative to the base. The turntable 24 is conventional and is driven by a fluid-drive motor 25 to provide rotational motion to the unit about a vertical axis 26. A second frame 28 is supported on turntable 24 to pivot around axis 26.

Supported on frame 28 is a prime mover 30 which in this embodiment is a diesel engine. The engine 30 drives a pair of hydraulic fluid pumps 32 for driving the traction motors 20 and the cutter head motor described below. The engine also drives another pump 34 for operating the numerous hydraulic cylinders which position the various elements of the present apparatus. A pair of hydraulic fluid tanks 36 provide the storage capacity for the hydraulic fluid used to operate the motors and cylinders.

The second basic unit supported by frame 28 is an extendable boom unit 38. In this embodiment, unit 38 is a unit commonly used for truck mounted backhoes and the like. The unit 38 is attached to frame 28 by means of a pivot axle 40 and the pivot angle is controlled by a pair of hydraulic cylinders 42. The boom portion 44 of unit 38 is rotatable about its longitudinal axis by means of a ring gear arrangement 46. An extendable portion 48 of boom 44 telescopes from within boom 44 to provide a variable extendable length. Each of the various motions of boom unit 38 is hydraulically controlled and powered from the prime mover 30. It can be seen from the arrangement so far described that the extendable boom portion 48 may, with respect to the base 10, translate laterally, rotate about a vertical axis, pivot about a horizontal axis, rotate about its own longitudinal axis, and extend along it longitudinal axis. These motions are, of course, additive to the basic motion of frame 10 which is able to translate by means of traction means 12 in essentially any direction on the surface of the earth.

Attached to the end of extendable boom 48 is a dual cutter unit shown generally as 50. Cutter unit 50 is attached to boom 48 by pivot 52 and a hydraulic cylinder shaft 54. The dual cutter 50 comprises a main body 56 containing reduction gearing within it and supporting a fluid-drive motor 58 and a pair of cutter wheels 60. Motor 58 drives directly into a gear reduction unit 62. The reduction unit 62 in turn drives a double chain drive speed reduction arrangement shown in more detail in FIG. 2. The two cutter wheels 60 are eight feet in diameter (seven feet without carbide teeth) and the teeth are spread over a five inch width. The cutter wheels are designed to rotate up to 105 revolutions per minute. The cutter wheels 60 are mounted on opposite ends of a shaft 64 which has an overall length less than the maximum spread between the outer teeth on the cutter wheels. The details of this arrangement are better illustrated with respect to FIG. 2.

Figure 2:
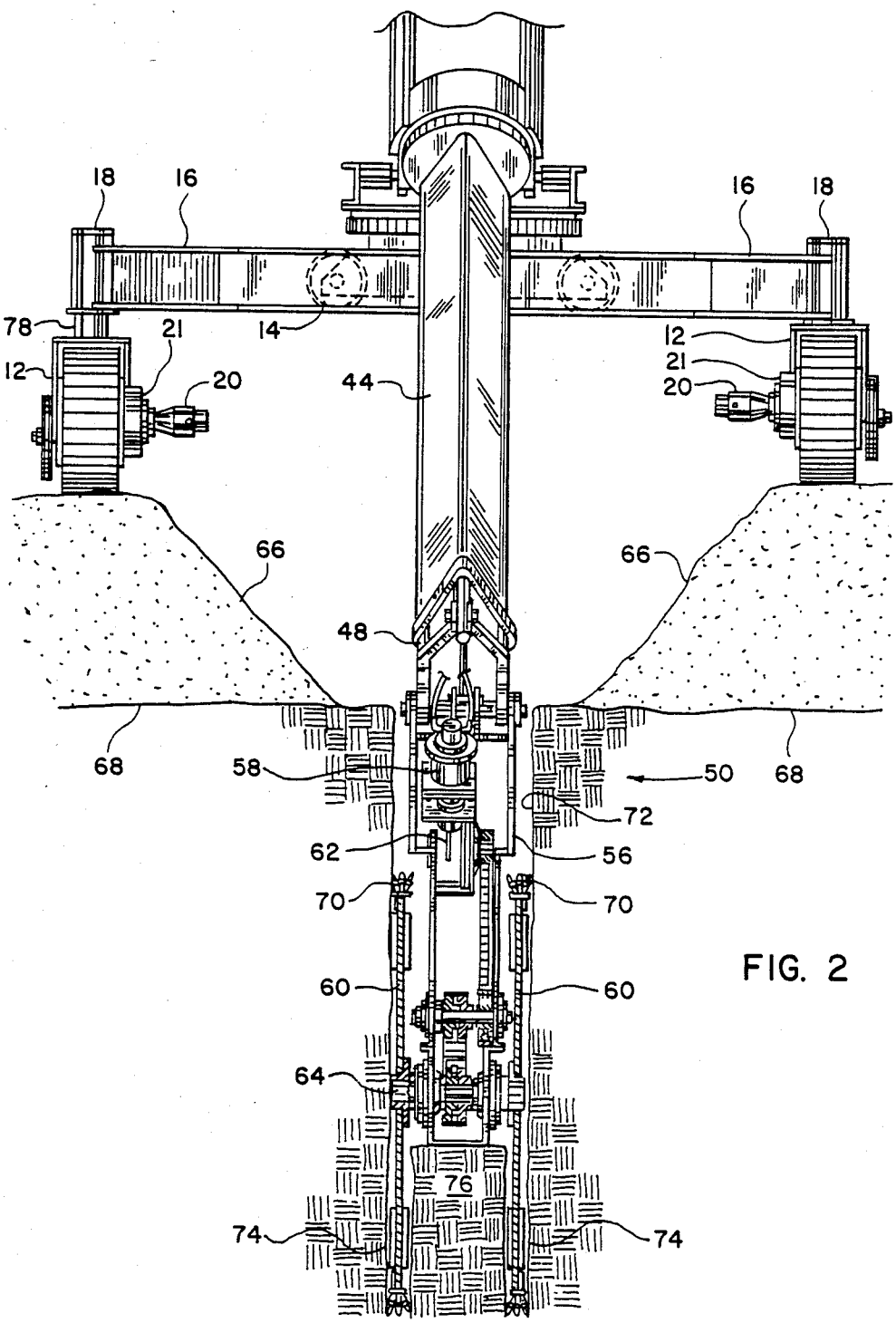
FIG. 2 is a partial front view of the apparatus of FIG. 1 illustrated in place within a rock trech.

With reference now to FIG. 2, a front view of the apparatus in FIG. 1 is illustrated in place cutting a deep trench in a rocky material. The same designation numbers are used to indicate the parts which are also illustrated in FIG. 1. In particular, the traction units 12 are shown resting on the top of banks 66 comprising loose or soft surface topsoil or sand. Below an interface 68 is a subsurface rocky material such as a limestone material. While limestone is relatively soft stone and could sometimes be cut by previously known trenching equipment, such cutting could be done only at a slow rate and would cause extreme wear on the equipment. The cutter wheels 60 have teeth 70 designed for cutting this type of rocky material at a fairly high rate, but equipment for using such cutter wheels has not heretofore been provided which could cut a trench deeper than about the radius of the cutter wheel. As noted above, the shaft 64 is shorter than the space between outside teeth 70 of cutter wheels 60 which in this embodiment is about thirty inches. Likewise, the housing 56 in which the driving mechanism is contained and even the extendable boom 48 and boom 44 are smaller than this thirty inch dimension so that the entire boom and drive mechanism may be extended down into a previously cut thirty inch wide trench. As illustrated in FIG. 2, an essentially vertical walled trench 72 has been cut ino the solid rock portion of the earth below the loose material 66. As illustrated, trench 72 was about eight feet deep when dual cutter 50 was inserted to make another cut at the bottom. The cutter 50 provides a pair of narrow slots 74 approximately three feet deep and each five inches wide with the outer edges of the cuts being approximately thirty inches apart. It can be seen that it is very important in this operation that the large cutter wheels 60 are correctly positioned within the previously cut trench 72 so that the contact of teeth 70 is limited to the bottom of the trench where the desired cut is to be made. Any misalignment of the cutters 60 would cause them to bite into the side walls of the trench greatly increasing the force needed to drive the wheels 60 and either stopping the cutting operation or damaging the wheels or the equipment.

In operation, a trench is cut in hard rock by first removing the soft topsoil layer to form banks 66 by use of conventional earth moving equipment. When the hard rock interface 68 is reached, the trench rock cutter according to the present invention is positioned over the topsoil cut 66 as shown in FIG. 2. The frame 28 is then positioned over the center of the cut by movement along rails 14 by hydraulic cylinders means not shown. The boom unit 38 is then rotated about vertical axis 26, tilted about pivot axis 40 and the boom is extended and rotated until the cutter wheels 60 contact the top surface of the rock formation. Before cutting begins, the wheels are carefully aligned to be parallel with the direction of the desired cut. The cutter wheels are then rotated and lowered into the rock face until they reach the maximum depth of about three feet. The entire unit may then be translated down the trench by means of traction units 12 as the parallel grooves 74 are cut into the rock face. As the entire unit moves, the boom unit 38 may be continually readjusted to ensure the parallel operation of the blades with respect to the direction of the desired cut. After the parallel cuts 74 have been made, conventional means such as backhoes, side chisels, or explosives are used to remove a central block portion 76 remaining between the two side cuts. It can be seen that once the side cuts 74 are made, the central portion 76 is much more easily removed than would be otherwise possible. After the first pass has been made and the central portion 76 has been removed, the rock cutter of this embodiment may be returned to the starting point and repositioned. The essentially universal articulation of the boom unit 38 is then employed to lower the cutter blades 60 into the previously cut trench with essentially no contact with the sides walls of the trench. In this way, the cutter blades may be lowered into the bottom of the previously cut trench to provide another pair of narrow grooves along the length of the trench. The remaining rock 76 is again removed by conventional means and the process may be repeated until a desired depth is reached. With the fairly simple apparatus of the present invention, total trench depths of approximately twenty-seven feet may be provided. It can be seen that with very little additional increase in size and weight of the equipment, the total cut depth may be increased by simply providing a longer boom arrangement 44.

As noted above, the base 10 is rectangular with the two rails 14 comprising the long sides of the rectangle. The remaining short sides 15 may also be used as rails for supporting the apparatus by wheels 22. Thus, if it is desired to operate with smaller spacing between traction units 12, the base 10 may be rotated 90° relative to wheels 22 with an appropriate change in wheel 22 spacing. The traction means 12 would then also be pivoted 90° on pivot units 18 and the entire unit would operate as described above, but with narrowed spacing between traction units 12. In the preferred embodiment, the base 10 is about seven by ten and one half feet. As an alternative, the connection between traction support arms 16 and the base 10 may be made flexible to allow the space between traction units 12 to be varied.

As noted above, traction unit pivots 18 are provided with means for raising base 10 relative to the units 12. This is shown as shaft 78 in FIG. 2. Not only does this improve traction, but it also allows base 10 to be levelled, which greatly facilitates alignment of cutter wheels 60 with a previously cut trench. But it can be seen that even if the base 10 is tilted with respect to the verticle, the articulation which is otherwise provided is sufficient to perfectly align the cutter wheels 60 within a previously cut trench.

The apparatus thus far described is adapted for cutting only a single width of trench, i.e. thirty inches. A simple means has been found for increasing the width of the cut. While shaft 64 could obviously be modified to have a length greater than thirty inches, it has been found more convenient to use hub extensions between the ends of shaft 64 and cutter wheels 60. Up to three, six inch extensions may be used on each end of shaft 64 to provide a trench width of up to sixty-six inches. While wider trenches provide more clearance for boom 44, the universal articulation of the cutter mechanism is still required to properly reenter a trench.

While many are not illustrated, for simplicity, it is apparent that fluid-driven cylinders, etc., are used to control the various allowable motions of the apparatus of FIGS. 1 and 2. Each of the fluid-driving means derives power from the prime mover 30.

Experience with use of the embodiment of the present invention illustrated in FIGS. 1 and 2 has shown that smaller embodiments of the present invention may be used to great advantage. In FIGS. 1 and 2 the apparatus is large enough to span a fairly broad ditch formed in loose material 66 by conventional equipment. In practice, it has been found much better to remove the topsoil layer above the interface 68 by use of the dual rock cutter apparatus of the present invention rather than more conventional apparatus. Cutting through even relatively unconsolidated topsoil with the apparatus of the present invention does very little to disturb the adjacent materials and in most cases a stable ditch wall can be formed even in the topsoil layer. As a result, it is not necessary to provide as much space between the traction means as was originally thought and as was provided in the FIG. 1 embodiment. It has also been found that with experience, an operator of the equipment can maintain the transport mechanism in very close alignment with a preselected traverse, including a previously cut trench. As a result, it has been found that only a small degree of lateral motion need be provided to the boom to allow repositioning of the cutter wheels in a previously cut trench. That is, while universal articulation is still required in most cases, the range of motion need not be as great as was first thought. As a result of the experiences with the FIG. 1 embodiment, various other embodiments, some of which are considerably smaller, have been developed and are described below.

Figure 3:
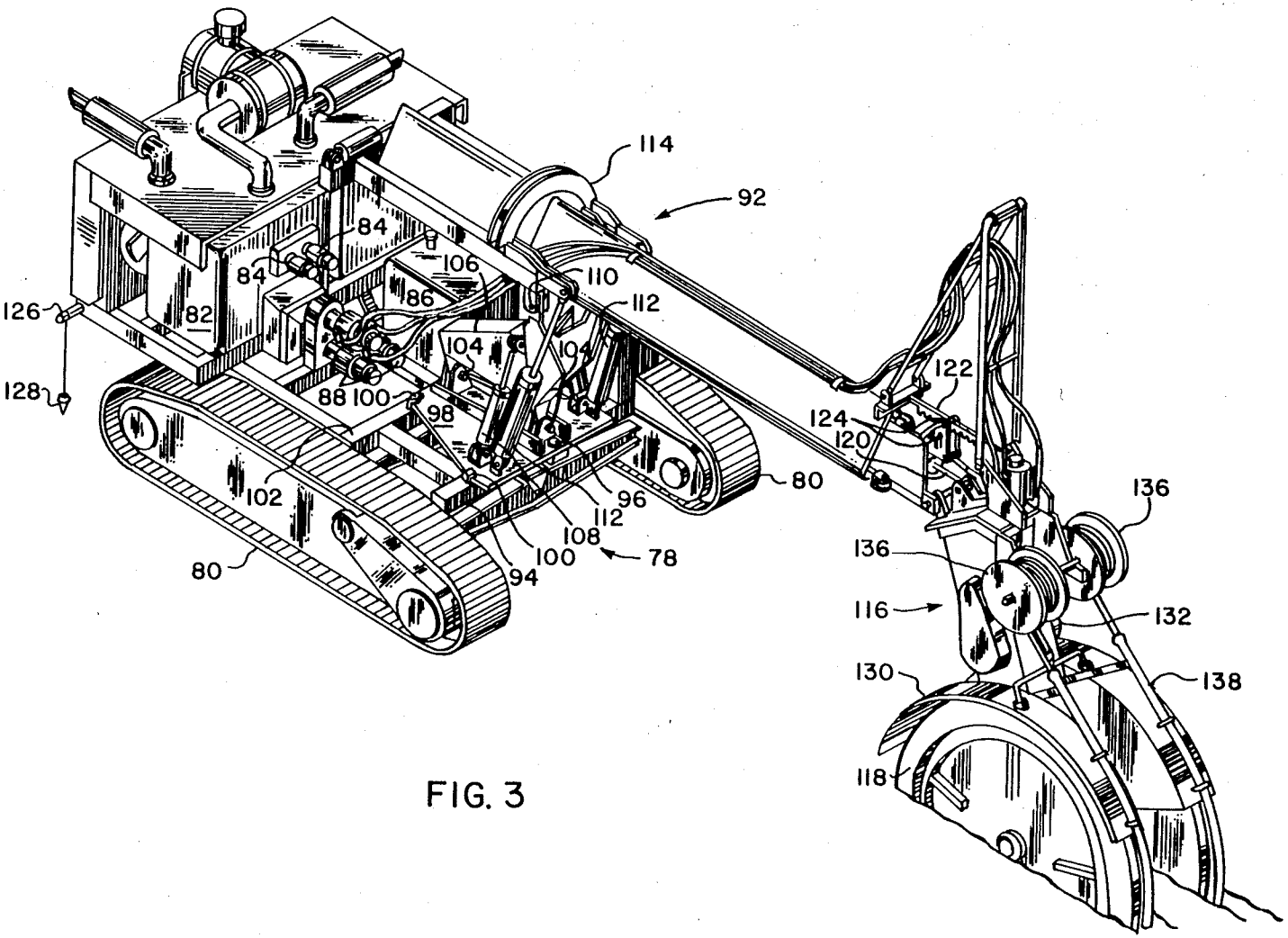
FIG. 3 is a perspective view of a second embodiment of the present invention.

With reference now to FIG. 3, second embodiment of the present invention is illustrated in perspective view. A transport means 78 for this embodiment is supported on a pair of crawler type traction means 80 and carries a diesel engine 82 for providing all power for the unit. This type of transport is commonly used for supporting conventional drilling equipment. The engine 82 drives a number of hydraulic pumps for powering both the tracks 80 and the trench cutting equipment carried on the transport. A pair of small constant output hydraulic pumps 84 are provided for driving numerous hydraulic cylinders which control positioning of the cutter blades as described below. A variable displacement hydraulic pump 86 is provided for driving the cutter blades at a variable and controllable rate. Two other variable displacement hydraulic pumps 88 are provided for driving the traction means 80 to also provide variable speed and steering. The hydraulic outputs from pumps 88 are coupled to a pair of hydraulic motors (not shown) which in turn drive the threads 80. This variable displacement hydraulic pump arrangement gives the operator a wide range of operating speeds and also allows automatic control as explained below with respect to other embodiments.

An extendable boom 92 which may be identical to the extendable boom 38 of FIGS. 1 and 2 is carried on the transport means 78. The coupling of the boom 92 to the base 78, as will be seen, provides essentially all of the motions provided in the FIG. 1 embodiment but with several of the motions limited to a narrower range of operation. In particular, there is provided on a front cross-beam 94 of the transport 78 a pivot point 96. A partial turntable 98 is supported upon pivot 96 for rotation about a vertical axis. A number of restraining guides 100 are provided on the forward cross beam 94 and an intermediate cross-beam 102 of the transport 78 for holding the plate 98 down while allowing limited rotation of the plate. In particular, in the present invention, the plate 98 is allowed to rotate a total of from 15° to 20° about the pivot point 96. With this limited motion, a simply hydraulic cylinder connected between plate 98 and either of the cross-beams 94 or 102 is quite sufficient for controlling the position of turntable 98.

The boom 92 is supported on the turntable 98 by what can be considered a universal joint connection. A longitudinal pivot axis is defined by a pair of pivot pins 104 carried on the front and back edges of turntable 98. A boom support member 106 is pivotally carried by the pivot pins 104 and thereby allowed to tilt or pivot to the left and right with respect to the longitudinal axis of the transport 78. A pair of hydraulic cylinders 108 are connected between the support element 106 and turntable 98 to control this left-right lateral movement of the boom 92. Another pair of pivot pins 110 connect the boom 92 to the support member 106 for providing pivoting of the boom 92 about a transverse axis relative to the transport 78. Another pair of hydraulic cylinders 112 is connected between the turntable 98 and the boom 92 to control the pivoting of the boom about pivot points 110.

This arrangement for supporting boom 92 on transport 78 provides limited rotation of the boom about a vertical axis and limited left-right translation of the boom by means of the pivots 104. In this embodiment, the left-right motion of boom 92 is limited to nine inches to the left and twelve inches to the right when facing the boom end of the machine with the difference being due to the fact that the operator's cab is normally positioned on the left side and interferes with further motion of the boom in that direction. It is apparent that lateral movement of boom 92 by pivoting also tends to pivot the cutter blades on the end of the boom which would cause misalignment of the blades in a previously cut trench. However, as with the FIG. 1 embodiment, the boom 92 includes a rotary bearing arrangement 114 which allows rotation of the extended portion of boom 92 about its own longitudinal axis. With only very limited use of this rotary bearing 114 any tilting caused by pivoting about pivot points 104 as well as any tilting caused by an uneven ground surface is easily compensated for.

In this FIG. 3 embodiment a cutter head attachment 116, which may be identical to that illustrated in FIGS. 1 and 2, is carried on the end of boom 92 and may be used in the same manner as described above. In this embodiment the rock cutter blades are essentially identical to those used in the FIG. 1 embodiment but have an outer diameter of 6.5 feet. In addition to hydraulic cylinder means 120 coupled between the boom 92 and the cutter head 116 for controlling relative position, an adjustable locking link 122 is also provided. Each cut made by the blades 118 is made at a relatively constant depth and it is usually desirable for the head 116 to be at a constant angle during the cutting process. Therefore the angle between the head 116 and boom 92 needs to be changed only when a new cut is started at a new depth. At such time the cylinder 120 may be used to readjust the head 116 relative to boom 92 and the link 122 is then fixed by pins 124 to maintain the constant relative angle.

With the features illustrated in FIG. 3 and thus far described, it can be seen that this FIG. 3 embodiment may be used in essentially the same manner as the FIG. 1 embodiment. That is, the transport 78 may be positioned over a preselected traverse on the earth's surface and moved along that traverse while the cutter blades 118 are used to cut a pair of slots having essentially vertical walls along that traverse. The depth of the cutting is controlled by pivoting the boom 92 about pivot points 110 under control of cylinders 112. Vertical alignment of cutter blades 118 can be controlled by rotating boom 90 by means of the rotary bearing 114. Should the transport 78 turn so that it is not parallel to the desired traverse, the entire cutter mechanism may be pivoted about the vertical pivot point 96 to maintain alignment with the desired traverse. Likewise if the transport 78 should be laterally displaced relative to the traverse, the boom 92 may be pivoted about the longitudinal pivot points 104 and thereby moved laterally so that alignment of boom 92 with the traverse is maintained. It will become apparent that the primary mechanism for aligning the boom 92 with the preselected traverse is in fact the transport means 78. The operator of the mechanism uses differential control of the speed of traction means 80 by controlling the output of the hydraulic pumps 88 to "drive" the transport 78 along the desired traverse. As is well known in the control of dual track transport mechanisms the mechanism actually tends to follow a somewhat zigzag course as the operator makes corrections to maintain alignment with the preselected traverse. That is, to move to the operator's right, the left track must be speeded up to rotate the transport 78 slightly out of alignment with the traverse so that its motion will carry it to the right and back into correct transverse position. Once at that correct transverse position, the operator must then speed up the right track to rotate the transport 78 back into correct alignment with the traverse. A skilled operator can maintain the transport 78 parallel with a preselected traverse and in proper transverse position relative thereto within fairly close limits. It is for this reason that the boom 92 is coupled to the transport 78 with universal articulating mechanisms which have only limited maximum motions but which are sufficient to maintain perfect alignment of the boom 92 as the transport 78 is driven.

A very simple, yet very effective, aid to the operator of the transport 78 is a simple string line alignment guide. In one form, this comprises a simple arm 126 extending transversely from the frame of the transport 78 and carrying a string or chain supported pointer or plumb bob 128. A string line may be laid out at a selected lateral position relative to a surveyed traverse and the lateral position of plumb bob 128 relative to the center line of transport 78 is accordingly adjusted. By positioning the alignment guide on the end of the transport 78 opposite from cutter wheels 118, the operator can quickly detect misalignment of transport 78 with the desired traverse. He can then make the slight adjustments required in the speed of tracks 80 to maintain the appropriate alignment.

Figure 4:
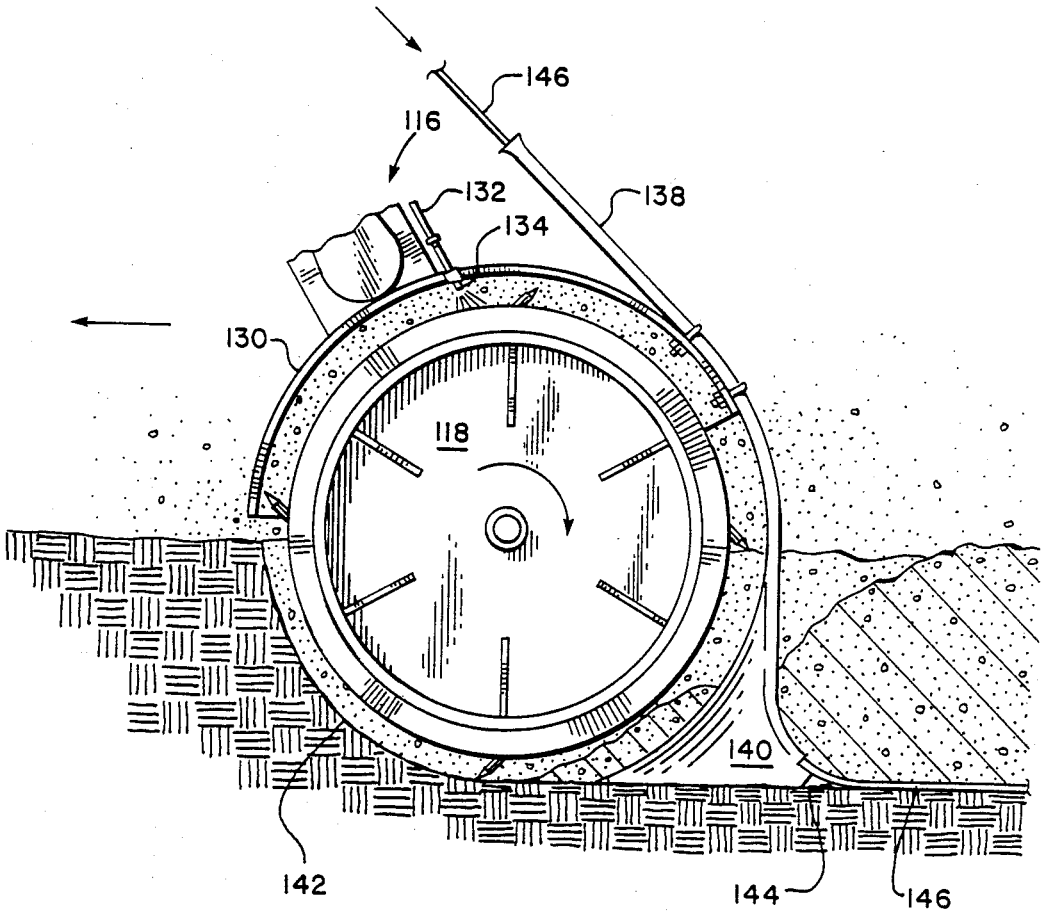
FIG. 4 is a partial side view of the apparatus of FIG. 3 in place within a rock trench.

Several other important features of the present invention are illustrated in FIG. 3 and in FIG. 4 which is a side view of the cutter head 116 and wheels 118 cutting a trench. It has been found desirable in most cases to provide fenders 130 spaced from the periphery of cutter wheels 118 to deflect cuttings back into the slots cut by the wheels. The fenders 130 aid in keeping down dust generated in the cutting process. Additional dust suppression is achieved by use of a fine mist water spray directed towards the cutter wheels 118. A hose and pipe condiut 132 carried by boom 92 and the head 116 conducts water to the location of the fenders 130. A pair of nozzles 134 are carried below the fenders 130 and directed towards cutter wheels 118. The water spray arrangement was initially intended to only keep down dust generated in the process. It has also been found very effective at cooling the cutter blades 118 and thereby greatly extending the life of the blades. A third advantage of the water spray which was not anticipated is consolidation of trench walls. As noted above, cutting trenches in the near surface or topsoil layers with the present apparatus does not disturb adjoining topsoil and vertically walled trenches usually result so that the total amount of material removed is greatly reduced. The water spray has been found to aid in consolidating these otherwise soft walls and reducing the chance of collapse or cave-in of the topsoil portions of the trench walls.

A final feature illustrated in FIGS. 3 and 4 is an arrangement for laying explosive cord in the bottom of slots cut by the wheels 118. This arrangment includes reels 136 of explosive cord carried on the cutter head 116, a tubular guide 138 supported on fenders 130 and a plow, or crumbing shoe, 140 carried on the end of guide 138. The guide 138 closely follows the periphery of the wheel 118 to the bottom of a trench cut by the wheel. The guide 138 then extends along the backside of plow 140 to the bottom portion of a slot cut by the wheel while the plow 140 curves back under the wheel 118 to push loose cuttings back into the path of the wheel.

FIG. 4 most clearly shows the details of this explosive cord laying process. Thus, in FIG. 4 it can be seen that cuttings removed from the trench at point 142 are carried up under the fender 130 and directed by the fender back down along the backside of cutter wheel 118 and thereby back into the slot 144 cut by the blade 118. It is desireable for the explosvie cord 146 to be positioned at the very bottom of the slot 144 for best results. It is also desireable for the slot 144 to be totally filled with cuttings above explosive cord 146 before detonation. It has been found that a majority of the cuttings tend to be thrown behind the wheel 118 by sufficient distance to fall above the explosive cord 146. Some of the cuttings however, tend to fall directly behind the blade 118 and tend to be positioned under explosive cord 146. The plow 140 closely follows the outline of cutter wheel 118 and pushes the cuttings in the slot 144 back into the path of blade 118 so that they are carried around the wheel for deposit behind the wheel a second time. This arrangement effectively provides a clear path for laying explosive cord 146 at the bottom of trench 144.

Trenches are cut with the apparatus of FIGS. 3 and 4 in the manner described with respect to FIG. 1. After the pair of vertical slots are cut by the cutter wheels 118 and the explosive cord has been laid in the bottom of the slots and tamped with cuttings deposited over the explosive cord, the mechanism can be removed from the trench momentarily while the explosive cord is detonated. This arrangement very effectively shatters the rock material between the slots 144 leaving a trench filled with rubble. This rubble is easily removed by a conventional backhoe having a clean vertically walled trench. This process is repeated to achieve greater depth as described above with respect to the FIG. 1 embodiment.

Figure 5:
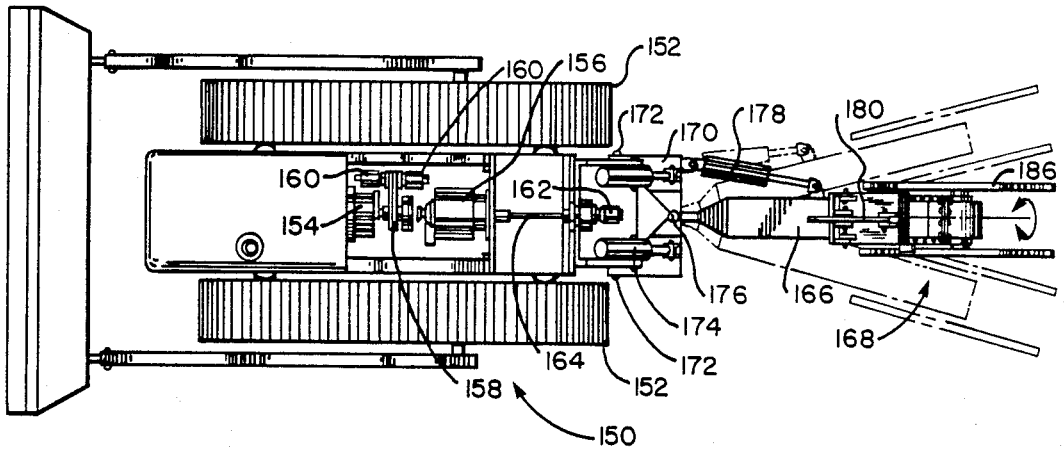
FIG. 5 is a plan view of third embodiment of the present invention.
Figure 6:
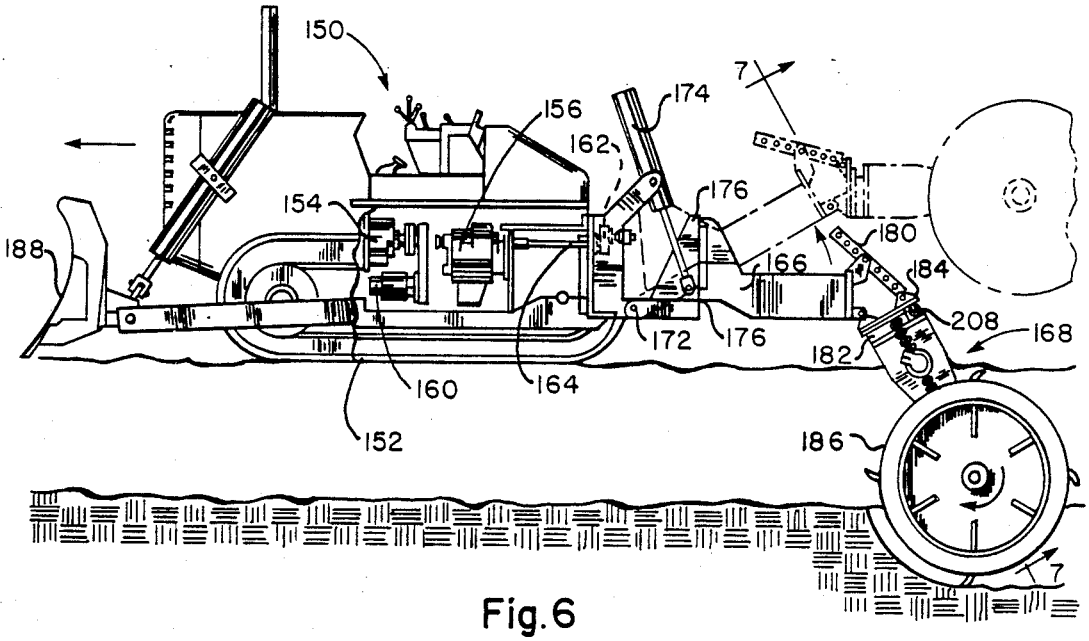
FIG. 6 is a side view of the embodiment of FIG. 5.

With reference now to FIGS. 5 and 6, there are provided top and side views of a third embodiment of the present invention in which a conventional bulldozer is modified and used as the transport means. The bulldoze 150 is, in this embodiment, a Fiat Allis 41-B 540 horespower tractor. Traction means therefore comprises a conventional pair of tractor threads 152. As shown in the broken away portions of the drawings, the tractor 150 has been modified to provide low speed motion required for the present invention. In particular, the conventional drive shaft connecting a torque converter 154 driven by the engine to a transmission 156 has ben removed. A gearbox 158 and at least three hydraulic pumps 160 have been coupled to the output of the torque converter 154. The hydraulic pumps provide fluid for driving the treads 152, the cutter wheels and the hydraulic cylinder actuators required for positioning the various portions of the apparatus. A hydraulic motor 162 is connected to a conventional drive shaft 164 normally used as a power take off from transmission 156. The motor 162 is driven by one of the hydraulic pumps 160 and provides low speed drive to transmission 156 which in turn drives the treads 152 in an otherwise conventional manner. These modifications were made since it is important in the present invention that the transport means, in this case tractor 150, move at a controlled constant rate while the rock cutter blades are cutting slots along the traverse. This type of tractor normally would not provide the desired motion at the required low speeds.

Figure 7:
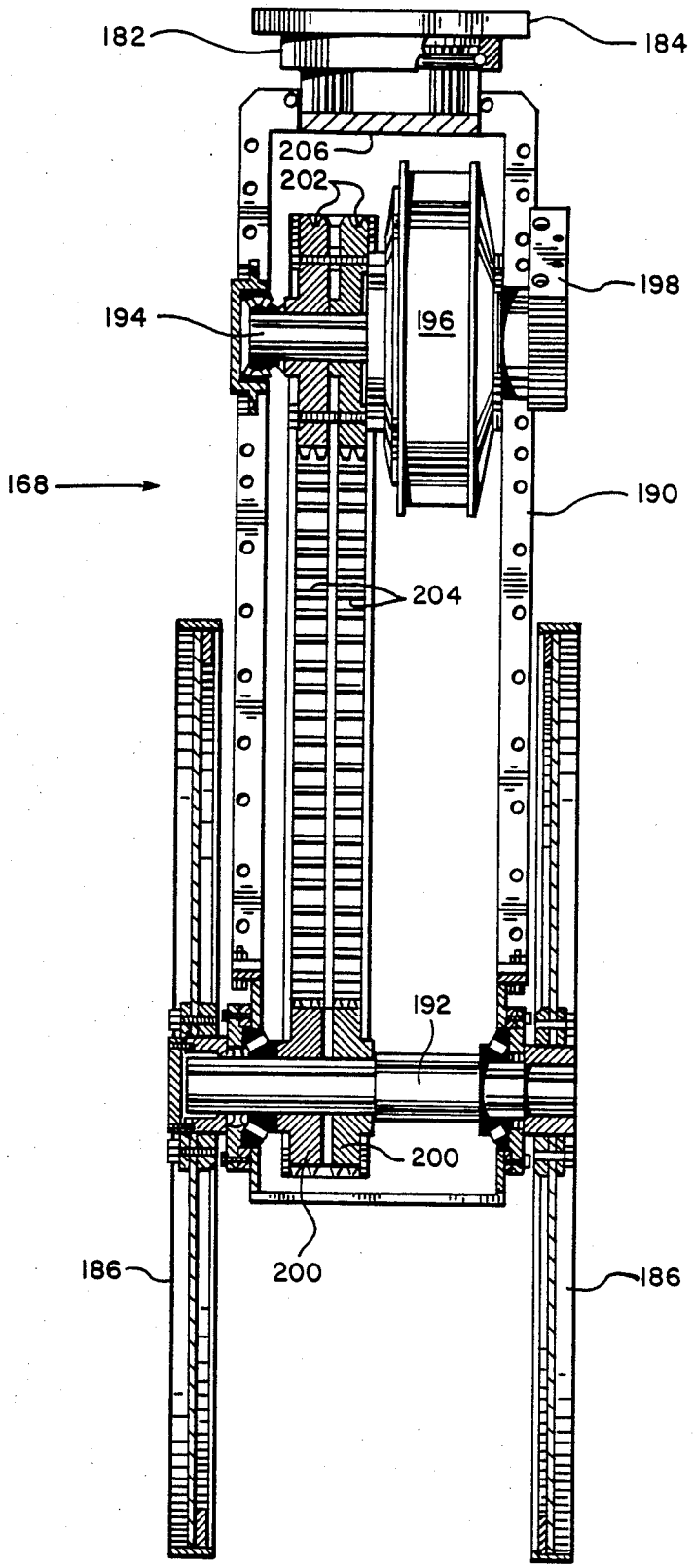
FIG. 7 is a cross-sectional view taken along the line 7—7 indicated in FIG. 6.

A boom 166 is carried from the rear of tractor 150 and supports a rock cutter head 168. In this embodiment, the boom 166 is connected to tractor 150 by a universal motion element 170. The element 170 is connected to the tractor 150 by two horizontally spaced pivot points 172 to provide rotation about a horizontal axis transverse to the center line of tractor 150. A pair of hydraulic cylinders 174 provide the means for controlling the position of element 170 about the pivot 172. The boom 166 is connected to the element 170 by a pair of vertically spaced pivot points 176 which allow the boom 166 to pivot about a vertical axis located near the rear of tractor 150. A hydraulic cylinder 178 controls the pivoting of boom 166 about this vertical axis. The cutter head 168 in this embodiment is an improved twin-blade rock saw attachment, details of which are illustrated in FIG. 7 and described below. The cutter head 168 is attached to the end of boom 166 by a locking link 180 essentally indentical to the link 122 in FIG. 3. Link 180 is again adjusted for a particular cut to provide a desired angle between cutting head 168 and boom 166. The cutting head 168 should remain either generally horizontal or generally vertical during the cutting of a particular trench depending upon the methods being used to cut a particular trench. In addition, cutter head 168 includes a rotary joint 182 which allows the main portion of the head 168 to be pivoted relative to a plate 184 which is connected to the boom 166. The details of this arrangement are better illustrated in FIG. 7.

In use it can be seen that the boom 166 may be pivoted right or left and up or down relative to the rear of tractor 150. In addition the cutter head 168, if in a vertical position, may be pivoted about a vertical axis for alignment of cutter blades 186 with a desired traverse. Therefore, for conventional cutting, the cutter head 168 is positioned generally vertically. The tractor operator then aligns the tractor 150 with the desired traverse with the treads straddling the trench location. It is desireable for the operator to have a string line guidance arrangement as shown in FIGS. 3 and 4 but he may use the edge of the blade 188 on the front of tractor 150 as his position indicator if desired. The operator then uses the hydraulic cylinder actuaters 174 and 178 to position the boom so that the cutter head 168 is positioned precisely above the desired trench location. If the tractor is not perfectly aligned parallel to and centered over the surveyed traverse, the cutter blades 186 will tend to be misaligned with the traverse and the rotary joint 182 is used to make a correction. The cutter blades 186 are then driven from one of the hydraulic pumps and lowered into the surface to begin cutting the trench. The driver then begins moving the tractor 150 along the traverse attempting to maintain precise alignment. As in the embodiment of FIG. 3, the driver's course corrections will pivot the tractor 150 out of alignment with the traverse. As this occurs, the boom 166 may be pivoted left or right as necessary to maintain the cutting head 168 precisely over the traverse. Angular errors of the blades 186 are then corrected by rotation of the cutter head at rotary joint 182. This articulation is sufficient therefore to correct for both lateral and angular displacements of the transport 150 relative to the desired traverse.

In some cases it will be desireable when cutting fairly shallow trenches requiring only one or two passes of the trench cutter to position the cutter head 186 in alignment with boom 166, that is generally horizontal. Thus, if a shallow ditch needs to be cut and the surface of the earth is unlevel, it is still desireable for the trench walls to be essentially vertical. In such a case, the rotary joint 182 can be used to maintain the cutter blades 186 vertical even when the tractor is leaning to the right or left due to the unlevel surface.

The embodiment shown in FIGS. 5 and 6 is generally intended for cutting shallower trenches than could be provided by the FIGS. 1 and 3 embodiments. The depth of trenches in this embodiment can however be increased by adding extensions between the end of boom 166 and the cutter head 168 itself. Since cutter head 168 is hydraulically driven there is no particular difficulty in providing such extensions. The arrangement as illustrated is intended for cutting to a depth of about nine feet and heavier equipment would normally be used for cutting deeper trenches.

Although not illustrated in this embodiment to simplify the drawing, it is desireable to include the water spray and explosive cord placement apparatus which was illustrated in FIGS. 3 and 4. With this additional apparatus, the embodiment of FIGS. 5 and 6 is used in essentially the same manner as discussed above. The only difference is that since lateral displacement is achieved by pivoting about a vertical axis at the back of tractor 150 it is necessary to provide the rotary joint in the cutter head 168.

With reference now to FIG. 7 there is provided a cross-sectional illustration of the cutter head 168 of FIGS. 5 and 6 taken along the line 7—7 FIG. 6. The new head 168 is less complicated than the cutter head 50 of FIGS. 1 and 2 and provides a cleaner exterior shape for positioning within trenches. In particular, this head 168 comprises a generally rectangular housing 190 having only two rotating axles 192 and 194 carried therein. The axle 192 carries the rock cutter wheels 186 in essentially the same way as provided in the FIG. 1 embodiment. The other shaft 194 is connected directly to the output of a hydraulic motor 196 carried completely within the housing 190. In this embodiment the motor 196 is sold under the Tradename and part number of Hagglund 4160 Hydraulic Motor. The only portions of the motor external of housing 190 are inlet conduits 198 provided for connection to flexible hydraulic hoses. The rotating shafts 192 and 194 are coupled together by a plurality of sprocket wheels 200 and 202 carried on shafts 192 and 194 respectively and coupled together by a chain 204. Due to the simple construction, this cutter head is believed to be preferable to that shown in FIGS. 1 and 2.

At an end of housing 190 opposite the cutter wheels 186, there is formed an end plate 206. The rotary joint 182 of FIGS. 5 and 6 is supported on this end plate 206. The plate 184 is also supported by the rotary bearing 182 and is the plate to which the boom 166 of FIGS. 5 and 6 is connected. Extension booms may also be connected to plate 184 if desired. In this preferred embodiment a hydraulic cylinder 208 (FIG. 6) is connected between the end plate 206 and the plate 184 to provide means for rotating the housing 198 relative to the plate 184. Only limited relative motion is required and the hydraulic cylinder arrangement is generally sufficient for this purpose. It is of course apparent that if greater extent of relative rotation was required that ring gears and rotary hydraulic motors could be employed for the purpose.

Figure 8:
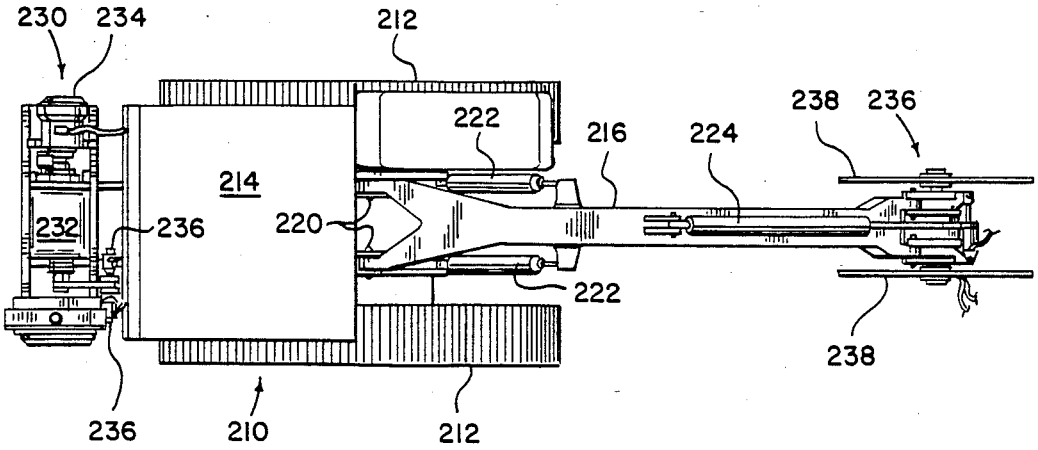
FIG. 8 is a plan view of a fourth embodiment of the present invention.
Figure 9:
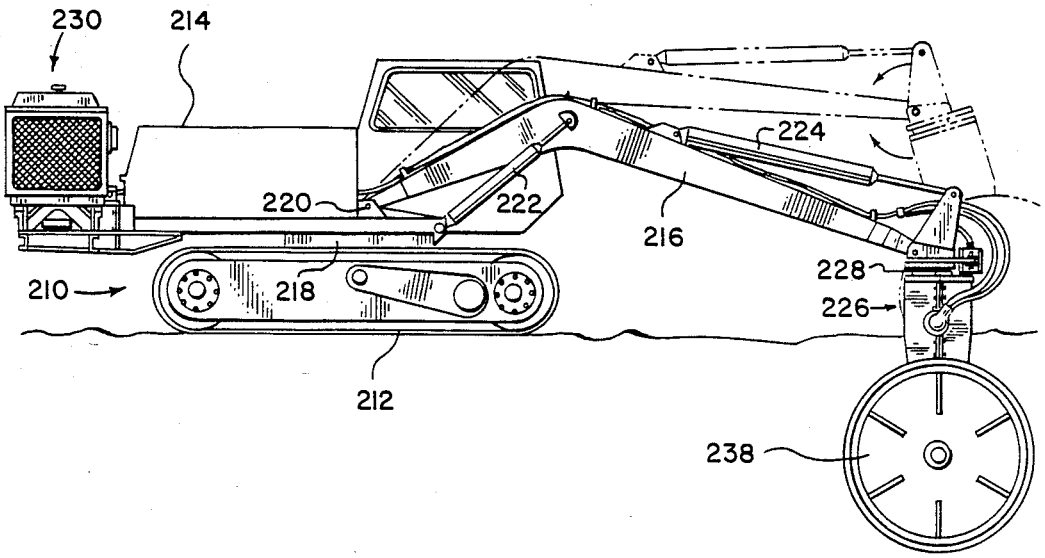
FIG. 9 is a side view of the embodiment of FIG. 8.

With reference now to FIGS. 8 and 9, there are provided top and side views of a fourth embodiment of the present invention. In this embodiment a transport mechanism 210 comprises a conventional tracked backhoe having a pair of crawler treads 212. The conventional mechanism also includes an engine 214 and a boom 216 both supported upon a turntable 218 carried by the tracks 212. The boom 216 may be raised or lowered about a horizontal pivot point 220 by means of hydraulic cylinders 222. Boom 216 is designed for carrying a bucket or scoop on its extended end and includes a hydraulic cylinder 224 fo controlling motion of that scoop, although the scoop is not used in this embodiment. In this embodiment, the rock cutter head 226, which is perferrably identical to that illustrated in FIGS. 5, 6, and 7 is supported on the end of boom 216 with its position controlled by cylinder 224. The cutter head 226 does preferrably include the rotary joint 228 in this embodiment.

As with other embodiments, the basic transport mechanism 210 has been heavily modified for use as a dual rock cutter trencher according to the present invention. An engine and hydraulic pump module 230 has been attached to the rear of the engine compartment 214 of the basic transport mechanism. This module includes another diesel engine 232 which drives a number of hydraulic pumps. A first variable displacement hydraulic pump 234 is connected to engine 232 to provide a variable speed drive to the cutter wheels in cutter head 226. Additionally a pair of variable displacement hydraulic pumps 236 are driven by engine 232 to provide power to the traction treads 212. The basic transport 210 employed hydraulic drives for the treads 212 but in the preferred embodiment these have been replaced with hydraulic motors which can provide slower speed operation. Each of the hydraulic motors is individually driven by one of the pumps 236 so that the speed of each traction means 212 may be very accurately and individually controlled. The remaining hydraulic cylinders and other actuators, such as the motor which controls the position of turntable 218, are driven by the original engine and hydraulic pump set 214 forming part of the basic transport mechanism 210.

In use, the embodiment of FIGS. 7 and 8 is again able to position rock cutter head 226 so that cutter blades 238 are accurately positioned along a desired traverse on the earth's surface. As with the other dual track transports the basic means for maintaining alignment with the traverse is the transport 210 itself. In this case, the boom 216 may pivot about a vertical axis by means of turntable 218 and may pivot about the horizontal axis 220. With these motions the extended end of boom 216 can be maintained along the appropriate traverse even when the traction means 210 is not in precise alignment. As with earlier embodiments, the rotary joint 228 allows the head 216 to remain perfectly parallel to the traverse even when the traction means 210 is misaligned.

As with the FIGS. 5 and 6 embodiment, the cutter head 226 may be positioned either vertically as shown in FIG. 9 or may be extended essentially horizontal from boom 216. In the vertical position as illustrated rotary joint 228 provides alignment as discussed above. In addition, this embodiment allows the cutting of trenches immediately adjacent an obstruction such as a building which abuts a right-of-way. That is the boom 216 may be pivoted by means of turntable 218 so that the cutter head 226 lies to the side of one of the treads 212. With the cutter head 226 vertical, the blades may then be rotated to be parallel to the desired traverse as the transport 210 moves along parallel but laterally displaced from the traverse. Again, it is desireable in all cases to provide some guide arrangment such as a string line so that the operator may maintain the treads 212 parallel to the traverse and at a preselected lateral displacement therefrom. It can be seen in this offset trenching arrangement that the bottom 216 could not be extended into previously cut trenches to any great extent. To increase the trench depth, an extension boom may be connected between the cutter head 226 and the boom 216 as discussed above.

If it is desired to cut a vertical walled trench in a sloping ground surface, the cutter head 226 may be positioned horizontally. If the traction means 212 are then uniformly spaced about the desired traverse and boom 216 is used to lower the mechanism into a trench the rotary joint 228 may be used to maintain the cutter wheels 238 in the vertical position.

Figure 10:
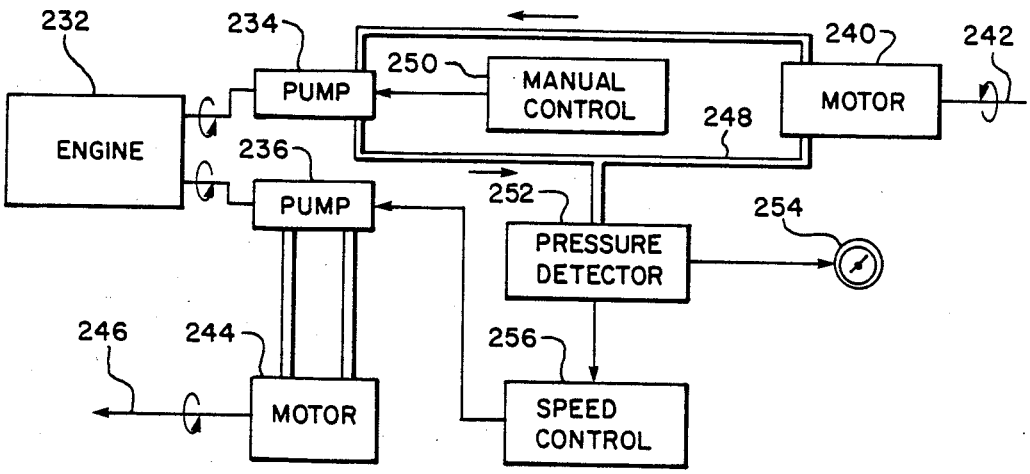
FIG. 10 is a schematic illustration of a speed control unit adapted for use with the apparatus of FIGS. 8 and 9 and other embodiments of the present invention.

With reference now to FIG. 10, there is illustrated a diagram of a speed control system found particularly useful with the present invention. As noted above, cutting of the slots forming the trenches in the present invention occurs primarily as the transport mechanism moves along the preselected traverse. The speed of cutting is therefore related to the speed of motion. It is of course clear that there are maximum limits to the cutting rate beyond which excessive power would be required and the cutter wheels would be damaged. On the other hand, it is apparent that if the transport mechanism moves too slowly the equipment will be operating below capacity, that is, inefficiently. In FIG. 10 an engine 232 and pumps 234 and 236 are the same as those shown in FIGS. 8 and 9. Pump 234 drives a hydraulic motor 240 having an output shaft 242 which drives the cutter wheels 238. Likewise a hydraulic motor 244 has an output shaft 246 for driving one or more crawler treads. A hydraulic fluid line 248 supplies hydraulic fluid from pump 234 to the cutter motor 240 at a rate controlled by a manual control device 250. As the motor 240 speed is increased manually by increasing the output of pump 234 the pressure in line 248 increases. In addition, as the resistance to rotation of the cutter wheels 238 increases, the pressure in line 248 also increases. A pressure detector 252 is coupled to line 248 and provides an output to an indicator dial 254. For automatic control, detector 252 also provides an output to an automatic speed control unit 256 which in turn provides an output coupled to the hydraulic pump 236. The speed control unit 256 causes the output of pump 236 to increase in response to a decrease of pressure in line 248 and likewise causes the output of pump 236 to decrease in response to an increase in the line 248. That is, as a resistance to cutting by wheel 238 decreases the drive motor speed is increased to move the transport 210 along the traverse more quickly which will in turn increase the resistance to cutting felt by the blades 238. In this way the unit may be run at a high output power level without fear of exceeding the limitations of the equipment. If, for instance, an excessively hard section of rock should be encountered, the resistance of cutting will increase and the speed control of 256 will automatically slow the transport mechanism and thereby avoid overloading the cutter wheels 238. The pressure indicator 254 is positioned where the operator of the mechanism can monitor the cutter motor pressure and make adjustments in the speed control mechanism 256 to increase or decrease the operating pressures. In general, the operator need only use the manual control 250 to control the output of pump 234 to thereby control the power supplied to the cutter wheels and the speed of the transport 210 will be automatically adjusted accordingly.

Great increases in cutting efficiency have been achieved without an automatic speed control system merely by use of the pressure detector 252 and indicator 254. The operator of the system sets the manual control 250 to a predetermined cutter motor speed and then manually controls the output of the drive motor pump 236 while observing the pressure supplied to the cutter motor 240. That is, as the cutter head pressure increases the operator slows the transport to avoid overloading the cutter wheels. The automatic system is preferred to relieve the operator of the constant observance of the pressure indicator 254. It is apparent that the FIG. 10 diagram is somewhat simplified since for directional control of the transport 210 a pair of the pumps 236 and motors 244 must be provided. The operator steers the transport by adjusting the relative speeds of the two drive motors which can be done by simply adding control signals modulating those supplied from speed control 256 to the variable displacement pumps 236. It is also apparent that this hydraulic speed control by reference to cutter head motor pressure is useful and preferred in essentially all embodiments of the present invention.

Figure 11:
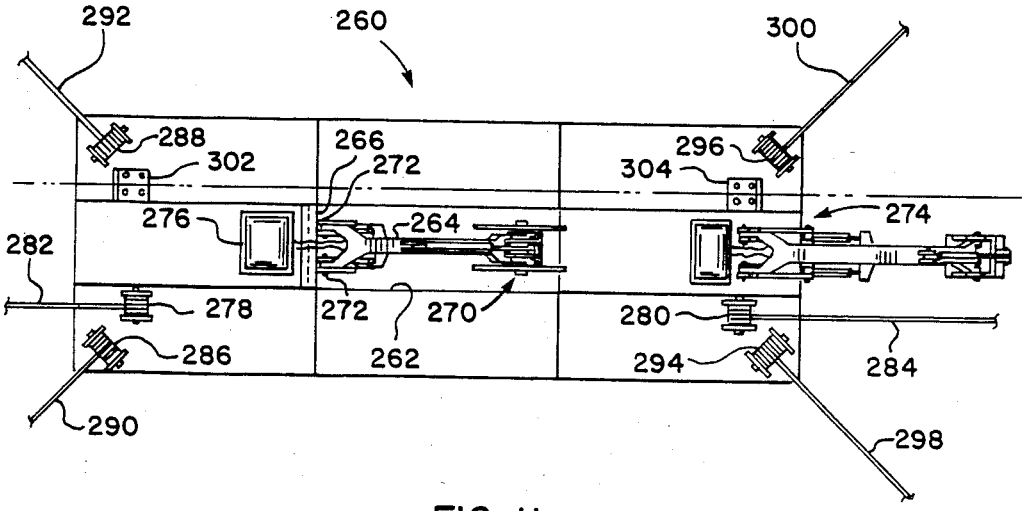
FIG. 11 is a plan view of a fifth embodiment of the present invention.
Figure 12:
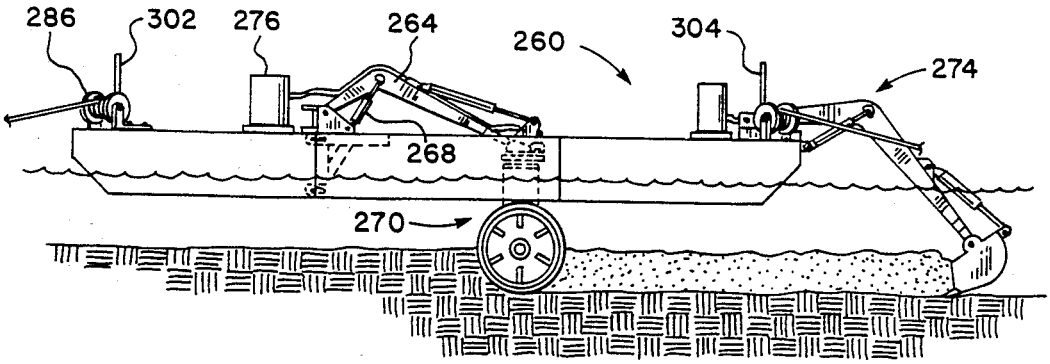
FIG. 12 is a side view of the FIG. 11 embodiment.

With reference now to FIGS. 11 and 12 there are provided top and side views of yet another embodiment of the present invention. Generally stated, this embodiment is a barge mounted trencher for use in cutting generally vertically walled trenches in the floor of a body of water. A barge 260 is provided having a central opening 262 extending through to the water. The barge 260 may be formed from eight modular barge units designed for assembly into barges of various shapes and sizes with a central module omitted to provide the opening 262. A boom 264 which may be identical to the boom 216 of FIGS. 8 and 9 is carried on a forward end 266 of the opening 262. The boom 264 may be raised or lowered by means of hydraulic cylinders 268 in a conventional manner. A cutter head 270 preferrably identical to that illustrated in FIGS. 7, 8 and 9 is suspended from the end of boom 264 in the same manner as previously illustrated and described. The attachment of boom 264 to wall 266 also preferrably allows some lateral translation of the boom 264 relative to the barge 260. For this purpose, pivots 272 support the boom 264 and are carried on transverse rails and a hydraulic cylinder (not shown) is provided for positioning the boom 264 laterally along the rails.

A conventional backhoe unit 274 is preferrably supported on an aft end 275 of barge 260 for clearing trenches cut by the cutter head 270. The backhoe 274 is preferrably mounted on a turntable so that rubble may be lifted and moved to the side of the desired traverse.

A power pack 276 similar to the unit 230 illustrated in FIGS. 8 and 9 is carried on barge 260 near the bottom 264. Power pack 276 provides the hydraulic fluid needed to power the cutter wheels on head 270 and the various hydraulic cylinder actuaters needed for positioning the head at an appropriate cutting location.

The barge 260 itself provides the support to the rest of the apparatus in this embodiment. Means for providing motion and appropriate positioning of barge 260 includes a number of winches, mooring lines and anchors. In particular, fore and aft winches 278 and 280 respectively are connected to mooring lines 282 and 284 which in turn are connected to anchors which are positioned in a conventional manner slightly offset from the desired location of the trench. In similar fashion, a pair of winches 286 and 288 are provided on left and right sides of the forward end of barge 260. Mooring lines 290 and 292 are connected to the winches 286 and 288 respectively and extend to anchors positioned laterally displaced from the traverse along which a trench is to be cut. In similar fashion, a pair of winches 294 and 296 and corresponding mooring lines 298 and 300 are carried on the rear of the barge 260.

The winch and mooring system thus far described provides means for both moving the barge 260 at a controlled rate along a desired traverse and also for maintaining the barge 260 both parallel to and precisely in transverse alignment with the desired traverse. Each of the winches is preferably hydraulically controlled. As a result, it is a simple matter to use a hydraulic speed control system such as that shown in FIG. 10 to drive the winches 278 and 280 to cause barge 260 to move along the traverse at a rate which will maintain constant cutting pressure on the rock cutter wheel 270.

In similar fashion, the lateral winches 286, 288, 294 and 296 may be automatically controlled to maintain precise alignment of the barge 260 with a traverse. To achieve this automatic alignment, a pair of laser targets 302 and 304 are positioned at the forward and rear ends of barge 260. Most subsea pipelines are laid out to a nearby shoreline. As a result, there is a stable ground surface available for positioning a laser light source. In this embodiment, a laser source is positioned and directed to provide a laser beam parallel to a desired pipeline location and positioned a few feet above the water surface. The laser targets 302 and 304 are then either manually or automatically aligned with the laser beam by appropriate differential control of the various winches to maintain the barge 260 in precise alignment with a desired path of operation. Differential light beam detectors suitable for use as targets 302 and 304 are well known and need not be described further here.

It can be seen that in the FIGS. 11 and 12 embodiment the transport means, which is the barge 260, provides both motion along the desired traverse and also means for providing almost perfect alignment with that traverse. The barge 260 also provides a very level base unlike the normal ground surface so that correction for right or left tilting is of no great concern. As noted above, it is desireable to provide some small amount of lateral shifting capability to the boom 264 and to provide the rotary joint in head 270 to compensate for the very small misalignments which can be expected in this barge mounted system.

Although physically quite different from the earlier embodiments, this FIGS. 11 and 12 embodiment is operated in essentially the same manner. That is, the transport 260 is used to position the cutter wheels over the surface in which the trench is to be cut and the cutter wheels are rotated and lowered into that surface. The transport 260 is then used to move the cutter mechanism along the traverse at a controlled rate while alignment of the blade with the traverse is maintained. It is preferred that the explosive cord placement arrangement of the FIGS. 3 and 4 embodiment be included in this barge mounted device. The preferred method of operation therefor includes the cutting of a pair of slots for a distance corresponding to the distance between boom 264 and the auxilary backhoe 274 at which time the explosive cord laid in that section is detonated. Cutting is then resumed while the barge 260 is moved along and the backhoe 274 is used to clear out the rubble from the section of trench formed by the previous detonation. It can be seen that is desireable to extend the length of barge 260 as much as possible so that relatively long sections of trench may be cut between successive detonations. This arrangement provides a very rapid method for providing a trench in the rocky floor of a body of water.

Figure 13:
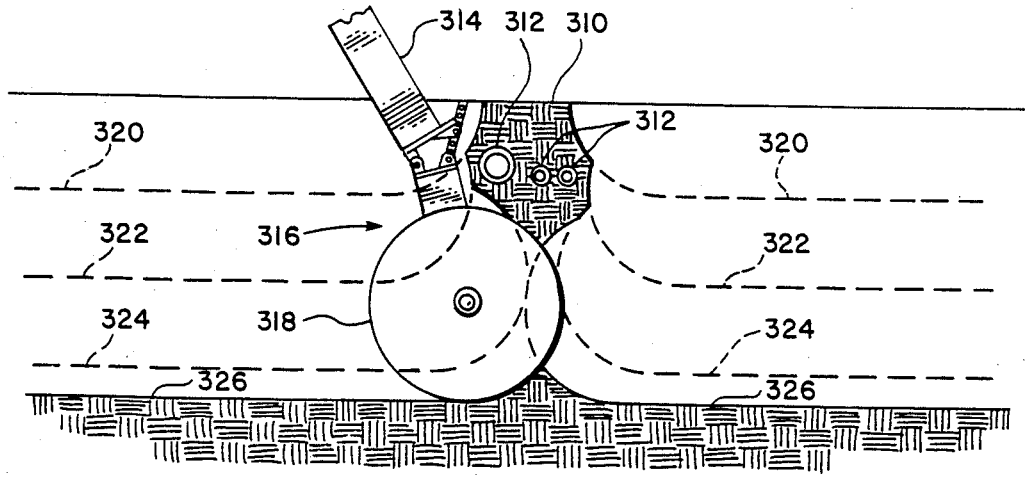
FIG. 13 illustrates an improved use of the apparatus of the present invention in cutting trenches beneath transverse pipelines.

With reference now to FIG. 13, there is illustrated a method of undercutting pipes and other conduits crossing the desired route of a trench. In FIG. 13, a ground surface is designated 310 and a number of conduits 312 are indicated positioned normal to the surface of the drawing. It if often necessary to lay a pipeline crossing the path of conduits 312 and generally this must be done at a lower position. A portion of a boom 314 carrying a cutter head 316 having rock cutter wheels 318 it is illustrated making a cut under the conduits 312. As is understood from the above descriptions, trenches are cut with apparatus of the present invention in a number of individual passes to reach a desired depth. The dotted lines 320 indicate the path of cutter blade 318 on a first pass which terminated short of the conduits 312 on opposite sides. Likewise second dotted lines 322 indicate the location of a second pass of rock cutter wheels 318. A third set of dotted lines 324 indicate the path of a third pass by the cutter wheels 318 which partially undercut the conduits 312 and almost formed a continuous passageway below the conduits. Fourth lines 326 indicates a final pass of the cutter wheels 318 which cut slots more than half way beneath the conduits 312 so that when the wheels 318 are also brought in from the opposite side a continuous path will be cut below the conduits 312. Due to the close control provided by the apparatus of the present invention, operators have been able to cut within a few inches of conduits such as conduits 312 without actually disturbing the overlying ground surface materials. This ability to undercut the crossing pipeline saves both time and money and avoids unnecessary damage to the crossing conduits.

While the present invention has been shown and illustrated in terms of specific apparatus, it is apparent that various modification and changes can be made within the scope of the present invention as defined by the appended claims.

What is claimed is:

1. Apparatus for digging a ditch in a horizontal surface of the earth, by means of a machine moving over the horizontal surface along a traverse, comprising:

transport means for moving over the horizontal surface of the earth along said traverse;

boom means carried by said transport means having a first end articulable downwardly into a substantially vertically walled ditch cut in the earth's surface below the surface traversed by the transport means;

rock cutter means comprising a pair of spaced rock cutter wheels each having a relatively large diameter-to-cutting width ratio adapted to cut spaced parallel slots in the earth's surface carried on the ends of a rotatable shaft journaled in a bearing housing, said shaft carried on said first end of said boom means; and alignment means for aligning the outer surfaces of said rock cutter wheels parallel to and between the walls of said ditch and for maintaining the cutter wheels aligned with the outer walls of previously cut slots as said transport means moves along said traverse whereby successive parallel cuts each to a depth up to the housing may be made along the bottom of said ditch after the material between a previous cut has been broken and removed to thereby extend said parallel walls to a preselected depth greater than the radius of the cutter wheels.

2. Apparatus according to claim 1, wherein:

said transport means comprises a frame carried on a pair of tracked traction means and an engine carried by said frame for powering said traction means;

said boom means comprises an extendable boom supported on said frame by means of turntable means for providing limited rotation of said boom about a vertical axis, said boom connected to said turntable means by a first horizontal pivot having a pivot axis in the plane of said boom and a second horizontal pivot having a pivot axis perpendicular to said plane, said boom means further including means for rotating at least a portion of said boom about its longitudinal axis; and said alignment means including control and actuator means for rotating said boom about said vertical and longitudinal axes and for pivoting said boom about said horizontal axes to align said rock cutter wheels between the walls of said ditch.

3. Apparatus according to claim 2, wherein:

said alignment means further includes an arm extending from said frame and having a marker for alignment with said traverse on the earth's surface, whereby said traction means may be maintained in alignment with said traverse as it moves along said traverse.

4. Apparatus according to claim 1 further including a hollow guide carried by said boom means and extending along the circumference of at least one of said rock cutter wheels to point spaced from a lower edge of said at least one wheel, and a supply of explosive cord carried by said boom and extending through said guide into a trench cut by said wheel, for positioning said explosive cord in said trench as said transport means moves along said traverse.

5. Apparatus according to claim 4 further including a crumbing shoe carried by said hollow guide for clearing loose cuttings from the bottom of said trench so that said cord may be positioned on the bottom of said trench.

6. Apparatus according to claim 1 further including water spray means comprising a water conduit carried by said boom and a nozzle for directing water from said conduit at the periphery of said cutter wheels to simultaneously cool said cutter wheels, suppress dust and consolidate walls of a ditch cut by said blades.

7. Apparatus according to claim 1, wherein:

said transport means comprises a dual tracked tractor having an engine for driving said tracks;

said boom means comprises a boom having a first end connected to said tractor by means of a vertical pivot and a horizontal pivot;

said rock cutter means is carried on a second end of said boom by rotation means for rotating said shaft and rock cutter wheels about a vertical axis;

said alignment means includes control and actuation means for pivoting said boom about said vertical and horizontal pivots and for rotating said shaft about said vertical axis to align said rock cutter wheels between walls of said ditch.

8. Apparatus according to claim 7 further including:

hydraulic pump means coupled to the output of said engine; and hydraulic motor means coupled to said rotatable shaft and driven by said hydraulic pump means;

wherein said actuation means comprises hydraulic cylinders driven by said hydraulic pump means.

9. Apparatus according to claim 8 further including:

a track driving hydraulic motor coupled to said tractor tracks for driving said tractor, said track driving motor coupled to said hydraulic pump means for receiving hydraulic fluid.

10. Apparatus according to claim 1 wherein:

said transport means comprises a dual tracked base, a frame carried on said base by means of a turntable for providing rotation about a first vertical axis, and engine means carried on said frame for propelling said transport means;

said boom means comprises a boom having a second end pivotally connected to said frame by a horizontal axle;

said rock cutter means is connected to said boom first end by a rotary joint allowing said rotatable shaft to rotate about a second vertical axis; and said alignment means includes control and actuator means for rotating said frame about said first vertical axis, for raising and lowering said boom about said horizontal axle, and for rotating said shaft about said second vertical axis, to align said rock cutter wheels between the walls of said ditch as said transport means moves along said traverse.

11. Apparatus according to claim 10 further including hydraulic pump means coupled to said engine means, first hydraulic motor means coupled to said track means and to said hydraulic pump means for propelling said track means, and second hydraulic motor means coupled to said rotatable shaft and to said pump means for rotating said cutter wheels.

12. Apparatus according to claim 11, wherein:

said hydraulic pump means includes first and second variable displacement hydraulic pumps, said first hydraulic motor means comprises first and second hydraulic motors coupled to said dual tracks, said hydraulic pump means further includes a third hydraulic pump coupled to said second hydraulic motor means;

further including control means coupled to said first, second and third hydraulic pumps for controlling the speed of travel of said transport means as a function of the fluid pressure at the output of said third hydraulic pump.

13. Apparatus according to claim 1, wherein:

said transport means comprises a barge having mooring line and winch means for moving said barge along said traverse on the earth's surface, said barge having a central opening extending from upper to lower surfaces;

said boom means comprises a boom having a second end pivotally connected to a wall of said central opening by a horizontal axle;

said rock cutter means is connected to said boom first end by a rotary joint allowing said rotatable shaft to rotate about a vertical axis; and said alignment means includes control and actuator means for controlling said mooring line and winch means for positioning said barge in alignment with said traverse, for raising and lowering said boom about said horizontal axle, and for rotating said shaft about said vertical axis, to align said rock cutter wheels between the walls of said ditch as said transport means moves along said traverse.

14. Apparatus according to claim 13, wherein:

said mooring line and winch means includes a forward pair of winches and mooring lines and a rear pair of winches and mooring lines, said mooring lines of each pair extending in opposite substantially lateral directions from said barge whereby said barge may be moved laterally and rotated about a vertical axis.

15. Apparatus according to claim 14, further including laser means for providing a light beam above and parallel to said traverse along the earth's surface, forward and rear light beam detectors carried by said barge, and automatic control means coupled to said detectors and to said forward and rear pairs of winches for automatically aligning said barge with said light beam.

16. Apparatus according to claim 13 wherein said mooring line and winch means includes a forward winch and a mooring line extending generally forward of said barge and a rear winch and a mooring line extending to the rear of said barge;

said rock cutter means including a hydraulic motor for driving said rotatable shaft and a hydraulic pump carried on said barge for driving said hydraulic motor;

further including speed control means having an input coupled to an outlet of said hydraulic pump and outputs coupled to said forward and rear winches, for controlling the speed of movement of said barge along said traverse as a function of hydraulic pressure at the hydraulic pump outlet.

17. Apparatus according to claim 13 further including lateral translation means connecting said horizontal axle to said barge for providing limited horizontal translation of said boom relative to said barge.

18. A method for digging a ditch through rock like material having parallel generally vertical walls along a traverse on the earth's surface comprising:

(a) cutting a first pair of parallel substantially vertically walled slots along said traverse by means of a pair of rock cutter wheels carried on opposite ends of a rotatable shaft, said shaft carried by a boom extending from transport means moving along said traverse;

(b) subsequently removing material between said first parallel slots by another means to provide a ditch having parallel substantially vertical walls;

(c) positioning said rock cutter wheels between and parallel to the walls of said ditch and cutting a second pair of parallel substantially vertically walled slots along said traverse by means of said rock cutter wheels, said second slots being aligned with said first slots;

(d) removing material between said second slots by another means; and (e) repeating steps (c) and (d) as required until a preselected depth has been reached.

19. A method of digging a ditch along a traverse on the earth's surface, said traverse crossing the path of a buried conduit, comprising:

(a) cutting a pair of parallel narrow slots in the earth along said traverse except in the region of said conduit by means of a pair of rock cutter wheels of preselected diameter, said wheels carried on opposite ends of a horizontal shaft supported on an articulated boom, said boom supported by a vehicle traveling along said traverse, the length of said shaft and width of said boom being less then the spacing between outer teeth on said rock cutter wheels;

(b) removing material between said slots;

(c) repeating steps (a) and (b) until the bottom of the last-cut slots is below said conduit a distance at least as great as the diameter of said rock cutter wheels;

(d) cutting extensions of said last-cut pair of parallel narrow slots through the material below said conduits and along said traverse by means of said rock cutter wheels by articulating said boom to move said wheels under said conduit from at least one direction; and (e) removing material between said slots in the region of said conduit.

20. A method of digging a ditch having parallel generally vertical walls along a preselected traverse on the earth's surface including:

(a) positioning a transport means in alignment with said traverse, said transport means carrying a boom extendable into the earth's surface and said boom carrying a pair of rock cutter wheels each having a narrow cutting width relative to the cutting depth and spaced apart a distance somewhat greater than the cutting width on opposite ends of a rotatable shaft;

(b) aligning said cutter wheels with said traverse and rotating said wheels while lowering said wheels into the earth's surface;

(c) moving said transport along said traverse while maintaining said rotating cutter wheels in aligment with said traverse to thereby cut a pair of substantially spaced, parallel, substantially vertically walled slots along said traverse;

(d) removing material between said slots to provide a ditch having parallel substantially vertical walls.

21. Apparatus for digging a ditch having parallel, generally vertical walls along a traverse on the earth's surface comprising:

transport means for providing support and including engine and traction means for moving said transport means along said traverse on the earth's surface;

boom means having a first end supported by said transport means and a second end articulable into a substantially vertically walled ditch cut into the earth's surface along said traverse;

rock cutter means comprising a pair of rock cutter wheels carried on ends of a horizontal rotatable shaft, said shaft being carried on said second end of said boom means and being lowerable into a substantially vertically walled ditch;

alignment means including means for positioning said boom second end over said traverse and for lowering said cutter wheels to cut slots in the earth and means for pivoting said horizontal shaft and rock cutter wheels about a generally vertical axis relative to the boom means to align said wheels with said traverse, and means for maintaining alignment as said transport means moves along said traverse, whereby angular and lateral misalignments of said transport means may be corrected for.

22. Apparatus according to claim 21 wherein said alignment means includes a vertical pivot coupling said boom means first end to said transport means and control and actuator means for pivoting said boom means about said vertical pivot for laterally moving said boom second end to a position on said traverse.

23. Apparatus according to claim 21 wherein said alignment means includes means for laterally displacing said boom first end relative to said transport means and thereby laterally moving said boom second end to a position on said traverse.

24. Apparatus according to claim 21 further including:

a generally elongate housing having a first end coupled to said boom means second end and a second end carrying said horizontal shaft;

a rotary joint connecting said housing to said boom second end; and actuator means for pivoting said housing relative to the boom about its longitudinal axis.

25. Apparatus according to claim 21 further including:

a hydraulic pump driven by said engine and a first hydraulic motor driven by said pump, said first hydraulic motor having an output shaft coupled to said horizontal shaft for driving said cutter wheels;

variable displacement hydraulic pump means driven by said engine and second hydraulic motor means driven by said variable displacement pump, said second motor means having at least one output shaft coupled to said traction means for driving said transport means along said traverse; and control means having an input coupled to an input of said first hydraulic motor and an output coupled to said variable displacement pump for controlling the speed of said second motor means in response to pressure of hydraulic fluid at said first hydraulic motor input.

26. Apparatus according to claim 25, wherein:

said traction means comprises at least first and second tracked traction means laterally spaced about a longitudinal centerline of said transport means;

said variable displacement pump means comprises first and second variable displacement pumps; and said second motor means comprises first and second hydraulic motors driven by said first and second variable displacement pumps respectively and having output shafts coupled to said first and second traced traction units respectively, whereby steering of said transport means may be accomplished by differentially controlling the displacements of said hydraulic pumps.

27. Apparatus for continuously cutting a slot in the earth's surface, placing explosive cord in said slot, and tamping said cord comprising:

transport means for providing support and moving along a traverse on the earth's surface;

boom means having a first end supported by said transport means and a second end articulable to a position on said traverse;

a pair of spaced rock cutter wheels carried on a rotatable shaft carried by said boom means second end for cutting a pair of parallel slots in the earth's surface as the cutter wheel is pulled behind the transport means;

shield means carried by said boom means spaced from an outer edge of said at least one cutter wheel and extending over a substantial portion of the upper half of said at least one cutter wheel to direct cuttings into a slot produced by said at least one cutter wheel; and guide means carried by said boom means extending behind said at least one cutter wheel to a point adjacent the bottom of said slot for guiding explosive cord into place at the bottom of said slot below said cuttings;

whereby detonation of the explosive cord will selectively fracture the rock between the two slots to form a ditch with parallel side walls when the debris is removed from the ditch.

28. Apparatus according to claim 27, further including a crumbing shoe carried by said guide means and positioned adjacent the bottom of said slot for clearing cuttings from the bottom of said slot whereby said explosive cord may be positioned on the bottom of said slot.

29. A method for digging a ditch along a traverse on the surface of the earth comprising:

cutting a pair of spaced apart narrow slots along said traverse by means of at least one rock cutter wheel carried on an articulated boom supported by transport means moving along said traverse;

during said cutting, guiding at least one explosive cord into a position along the bottom of at least one of said slots;

during said cutting, directing cuttings from said at least one slot back into said slot to cover said at least one explosive cord;

detonating said at least one explosive cord in said at least one slot to fracture material between said slots; and removing material between said slots.

30. A method of digging a ditch according to claim 29 further including repeating the steps of claim 29 one or more times until a preselected depth is reached.

31. A method of excavating a trench having a preselected width in rock comprising:

simultaneously cutting a pair of narrow slots in the rock by means of a first self-propelled machine moveable over the surface and having a pair of rock cutter wheels carried on opposite ends of a horizontal shaft supported on an articulated boom, the length of said shaft and width of said boom being less than said preselected width and said wheels being spaced apart so that the outer edges of said slots are spaced by said preselected width and a substantial amount of material is left between the slots; and subsequently breaking and removing the material left between the slots by a second self-propelled machine left between said narrow slots.

32. A method according to claim 31 further including repeating said steps of cutting narrow slots in said rock in the bottom of the trench using cutter wheels of the same width and spacing and removing said rock between said slots one or more times until a ditch having generally planar, parallel walls and a preselected depth is reached.

* * * * *